US007128635B1

(12) United States Patent
Liu

(10) Patent No.: US 7,128,635 B1
(45) Date of Patent: Oct. 31, 2006

(54) MOLDED SEAMLESS BRASSIERE INCORPORATING FASTENERS

(75) Inventor: Zhen Qiang Liu, Kwai Chung (HK)

(73) Assignee: Regina Miracle International Ltd., Hong Kong (HK)

( * ) Notice: Subject to any disclaimer, the term of this patent is extended or adjusted under 35 U.S.C. 154(b) by 0 days.

(21) Appl. No.: 11/266,939

(22) Filed: Nov. 4, 2005

(51) Int. Cl.
*A41C 3/12* (2006.01)
*A41C 3/02* (2006.01)

(52) U.S. Cl. ..... 450/39; 450/92; 450/93; 450/58; 450/94; 24/558.12; 24/592.1; 24/695; 24/697.2

(58) Field of Classification Search ..... 450/1, 450/39, 92, 93, 94, 58; 2/96, 78.1–78.4, 2/73; 156/245, 73.1, 60, 88; 264/152–155, 264/157, 257, 258, 291, 292, 294, 320, 321, 264/163, 145, 148, 160; 24/588.12, 592.1, 24/695, 697.2
See application file for complete search history.

(56) References Cited

U.S. PATENT DOCUMENTS 3,528,140 A * 9/1970 Waldes ..... 24/695
3,772,899 A * 11/1973 Novi ..... 66/176
4,183,121 A * 1/1980 Cousins ..... 24/588.1
5,820,443 A * 10/1998 Burr ..... 450/40
6,837,771 B1 * 1/2005 Falla ..... 450/39
6,863,589 B1 * 3/2005 Cano ..... 450/65
2004/0224604 A1 11/2004 Luk ..... 450/39

FOREIGN PATENT DOCUMENTS

JP 2004-263315 9/2004

* cited by examiner

*Primary Examiner*—Gloria M. Hale
(74) *Attorney, Agent, or Firm*—Ostrolenk, Faber, Gerb & Soffen, LLP

(57) ABSTRACT

A method of incorporating a fastener with a molded brassiere of a seamless construction and that includes an exterior panel of moldable material and an interior panel of moldable material that is contiguous with the exterior more panel and has been laminated therewith except at at least a non-laminated region where the fastener is to be located, and wherein the fastener includes a connector supported by a flexible mounting panel, the method comprising creating an opening through one of the exterior panel and the interior panel at the non-laminated region and at a location thereof through which at least part of the connector is to extend, locating the flexible mounting panel intermediate of the exterior panel and the interior panel at the non-laminated region in a manner to allow the at least part of the connector to extend through the opening, affixing at least one of the exterior panel and the interior panel to the flexible mounting panel.

23 Claims, 11 Drawing Sheets

MOLDED SEAMLESS BRASSIERE INCORPORATING FASTENERS

FIELD OF THE INVENTION

The present invention relates to molded seamless brassieres including fasteners which are incorporated in a manner to be substantially unobtrusive from view.

BACKGROUND OF THE INVENTION

Molded brassieres are known. For example, US 20040224604 describes how a brassiere made from moldable materials can be made without any or no significant use of stitching, at least to the perimeter shape of the brassiere and preferably also at any other parts of the brassiere.

Perimeter stitching or stitching elsewhere on a brassiere to hold components of the brassiere together can be undesirable. Stitching can have a tendency to come undone and unravel thereby affecting the integrity of the bra. Regions of stitching that are exposed may also irritate the skin of the wearer of the bra. Furthermore the incorporation of stitching is also time consuming as it needs to be controlled by a person and is hence a labour intensive exercise.

Brassieres of a shape that includes two breast cup regions from each of which part of a chest band extends are the most common form of brassieres. At the end of each chest band are provided clasps or connectors that, when the chest band portions are in part wrapped around the torso of a person, can allow for the connectors to become mutually engaged to thereby ensure that the bra remains attached to the wearer of a person. The connectors used in traditional forms of brassieres include a series of hooks and eyes usually made of a metal wire that can become mutually engaged with each other. The hooks and eyes are normally mounted by sewing or stitching, onto a mounting panel or tape. In the traditional form of brassiere, the mounting panel or tape is sewn onto the chest band portions of the brassiere at or towards their free end. Again such a sewing step is labour intensive as it needs to be done by a person. Furthermore such mounting panels or tapes are normally sewn onto an exterior of a chest band and can have an un-aesthetic appearance. In addition the sewn or stitched panels, if not finished to a degree where it is relatively smooth, can also cause irritation to the back of a person wearing the brassiere.

Accordingly it is an object of the present invention to provide a molded brassiere incorporating fasteners which addresses the abovementioned issues or which will at least provide the public with a useful choice.

BRIEF SUMMARY OF THE INVENTION

Accordingly in a first aspect the present invention consists in a method of incorporating a fastener with a molded brassiere of a kind that is of a seamless construction and that includes an exterior more panel of moldable material and an interior more panel of moldable material that is contiguous with said exterior more panel and has been laminated therewith save for at at least a non-laminated region where said fastener is to be located, and wherein said fastener includes a connector supported by a flexible mounting panel, said method comprising;

creating an opening through one of said exterior more panel and said interior more panel at said non-laminated region and at a location thereof through which at least part of said connector is to extend, locating said flexible mounting panel intermediate of said exterior more panel and said interior more panel at said non-laminated region in a manner to allow said at least part of said connector to extend through said opening, affixing said exterior more panel and/or said interior more panel to said flexible mounting panel.

Preferably said connector is selected from one of a hook and an eye.

Preferably said affixing said exterior more panel and/or said interior more panel to said flexible mounting panel is by laminating.

Preferably said affixing is facilitated by a thermo sensitive adhesive intermediate of said flexible mounting panel and one or both of said interior and exterior more panels to, by application of heat and pressure to push said exterior and interior more panels towards each other, laminate said exterior and/or interior more panels with said flexible mounting panel.

Preferably said thermo sensitive adhesive is pre-applied to said flexible mounting panel.

Preferably said fastener is engaged at or near the free end of a chest band region of said brassiere.

Preferably two of said fasteners are incorporated with said molded brassiere, a first of said fasteners includes a hook as said connector engaged at a free end of a first chest band region of said brassiere, and a second of said fasteners includes a loop as said connector engaged at a free end of a second chest band region of said brassiere and to cooperate with said hook to engage the free ends of each said chest band region together.

Preferably said flexible mounting panel is captured entirely between said exterior and interior more panels and said at least part of said connector protrudes through said opening.

Preferably said flexible mounting panel supports a plurality of connectors for each of which a separate opening is created through said exterior or interior more panels.

In a second aspect the present invention consists in a method of capturing a fastener intermediate of an exterior more panel of moldable material and an interior more panel of a moldable material that are to define the breast cup regions and chest band regions of a molded brassiere of a kind which is of a seamless construction wherein said exterior more panel has been contiguously laminated with said interior more panel save for at at least a non-laminated region where said fastener is to be located, wherein said fastener includes a connector supported by a flexible mounting panel, said method comprising;

creating an opening through one of said exterior more panel and said interior more panel at said non-laminated region and at a location thereof through which at least part of said connector is to extend, locating said flexible mounting panel intermediate of said exterior more panel and said interior more panel at said non-laminated region in a manner to allow said at least part of said connector to extend through said opening, affixing said exterior more panel and/or said interior more panel to said flexible mounting panel.

Preferably said exterior and interior more panels are molded to introduce two breast cup regions simultaneously with the affixing of said exterior more panel and/or said interior more panel to said flexible mounting panel.

Preferably said connector is selected from one of a hook and an eye.

In a further aspect the present invention consists in a method of making a brassiere comprising laminating an exterior more moldable panel with a contiguous interior more moldable panel save for at at least one region locating at said at least one region and intermediate of said exterior more moldable panel and said interior more moldable panel a flexible mounting panel supporting a connector in a manner to protrude at least part of said connector through an opening of one of said interior and exterior more moldable panels affixing said interior and/or exterior more moldable panels to said flexible mounting panel.

Preferably said connector is selected from one of a hook and an eye.

Preferably said affixing is by laminating to capture said flexible mounting panel intermediate of said exterior and interior more moldable panels.

Preferably during said laminating of said interior and exterior more moldable panels a release ply is placed intermediate of said interior and exterior more molded panels.

In still a further aspect the present invention consists in a molded and seamless brassiere comprising;

an interior more panel of at least one ply of a moldable material, an exterior more panel of at least one ply of a moldable material, wherein at least one of said plies of said exterior more panel is contiguous with at least one ply of said interior more panel, and wherein said panels are laminated to each other save at at least one region where a flexible mounting panel supporting a connector is laminated to said interior and/or exterior more panels, capturing the flexible mounting panel intermediate of said interior and exterior more panels, wherein said connector is affixed to and at least in part projects from said flexible mounting panel, wherein one of said interior more and exterior more panels includes an opening therethrough for that part of said connector that projects from said flexible mounting panel to extend through.

Preferably said connector is selected from one of a hook and an eye.

Preferably said interior and exterior more panels each extends to define two breast cup regions of said brassiere and two chest band portions, each one of said chest band portions extending from a respective breast cup region to a free end of said chest band portion, wherein at said free end of one of said chest band portions, said flexible mounting panel is located to present at least part of said connector through one of said interior and exterior more panels for fastening with a complementary shaped connector engaged at the free end of the other of said chest band portions.

Preferably said complementary shaped connector is mounted by a flexible mounting panel and is one selected from the other of said hook and eye, the other of said chest band portions capturing said second mentioned mounting panel intermediate of said interior and exterior more panels and including an opening through one of said interior more panel and said exterior more panel to allow at least part of said complementary shaped connector to pass therethrough.

In still a further aspect the present invention consists is a molded and seamless brassiere of a kind that that includes an exterior more panel that includes at least one ply of moldable material and an interior more panel that includes at least one ply of moldable material, said interior and exterior more panels are contiguous to each other and define at least two breast cup regions and a chest band portion extending from each said breast cup region, said interior more and exterior more panels are laminated together save for at at least a region proximate the free end of a said chest band portion where a chest band fastener is located, wherein said chest band fastener includes one of a hook and an eye that is affixed to a flexible mounting panel captured intermediate of and laminated to said interior more and exterior more panels, one of said interior and exterior more panels including an opening through which said hook or eye extends.

In yet a further aspect the present inventions consists in a method of incorporating a fastener with molded brassiere of a kind that is of a seamless construction and that includes an exterior more panel of moldable material and an interior more panel of a moldable material that is contiguous with said exterior more panel and has been laminated therewith save for at at least a non-laminated region where said fastener is to be located, and wherein said fastener includes a connector selected from one of a hook and a loop supported by a flexible mounting panel, said method comprising;

creating an opening through one of said exterior more panel and said interior more panel at said non-laminated region and at a location thereof through which at least part of said connector is to extend, locating said flexible mounting panel intermediate of said exterior more panel and said interior more panel at said non-laminated region in a manner to allow said at least part of said connector to extend through said opening, laminating said exterior more panel and/or said interior more panel to said flexible mounting panel said laminating being facilitated by a thermo sensitive adhesive intermediate of said flexible mounting panel and one or both of said interior and exterior more panels to, by application of heat and pressure to push said exterior and interior more panels towards each other, laminate said exterior and/or interior more panels with said flexible mounting panel.

Preferably said connector is selected from one of a hook and an eye.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

BRIEF DESCRIPTION OF THE DRAWINGS

A preferred form of the present invention will now be described with reference to the accompanying drawings in which.

DETAILED DESCRIPTION OF THE PREFERRED EMBODIMENTS

Figure 1:
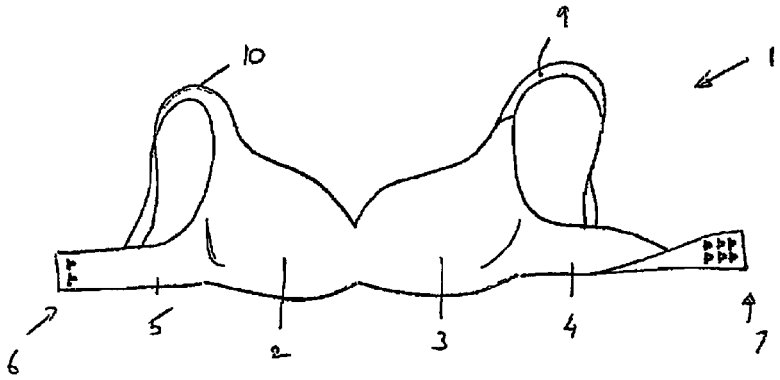
FIG. 1 is a front view of a seamless molded brassiere of the present invention shown in a lay flat condition with the free end of the right chest band turned to show the eyes.

With reference to FIG. 1 there is shown a molded and seamless brassiere 1 (hereinafter "bra"). The bra 1 includes two breast cup regions 2, 3. From each of the breast cup regions 2, 3 there extends a chest band portion 5, 4 respectively. At the free end 6, 7 of each chest band portion 5, 4 respectively, the chest band portions can become mutually engaged to define a chest band holding the bra about the torso of the wearer of the bra 1.

The breast cup regions 2, 3 and at least the chest band portions 4, 5 are preferably of a unitary assembly of an exterior more panel 11 and an interior more panel 12 that each are or each includes contiguous plies of moldable fabric and/or foam material. In the most preferred form, both the exterior more panel 11 and the interior more panel 12 comprise a fabric ply or layer laminated to a foam ply or layer. Reference is made to US 20040224604 which includes an example of a molded and seamless bra and describes the steps for its construction, and which is by way of reference hereby incorporated.

Figure 2:
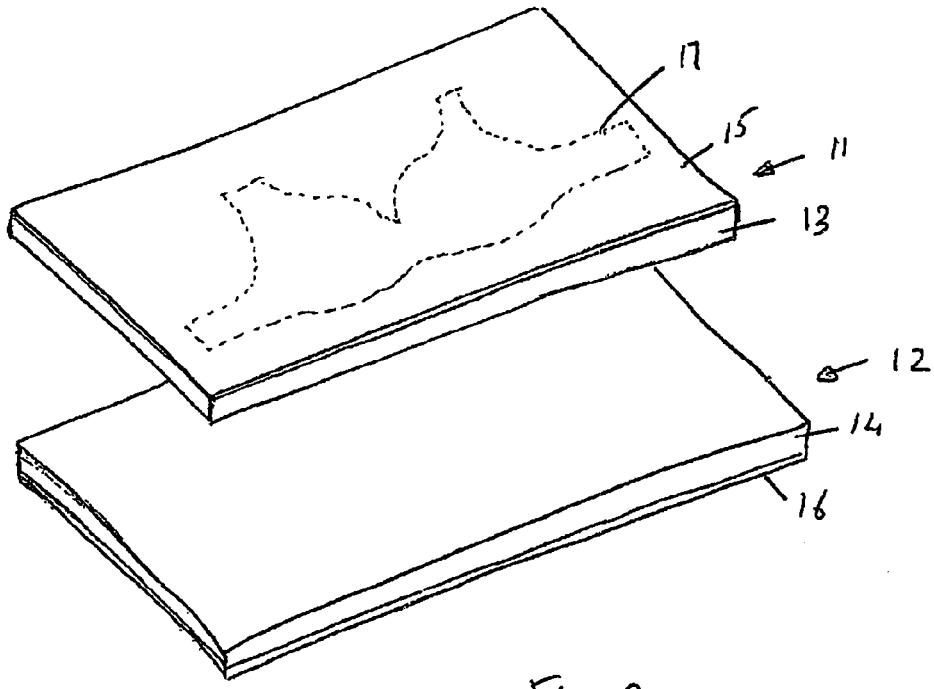
FIG. 2 illustrates an example of two precursor panels of material (an interior more and exterior more panel), each incorporating two plies that, in conjunction with use of a molding device can generate by mold forming, the main components of the brassiere.

With reference to FIG. 2, there is shown an exterior more panel 11 and an interior more panel 12 that are shown in their precursor condition prior to their being molded to the appropriate shape and laminated together. Each panel 11, 12 may include a foam ply 13, 14 and a fabric ply 15, 16. The panels 11, 12 are preferably of a size sufficient to allow for the desired main component shape 17 (shown in phantom in FIG. 2) to be defined therein. Whilst additional plies may be incorporated within the main component (being that part of the bra defined by parts which define at least the joined breast cups and chest bands) of the bra in addition to the panels 11 and 12, for convenience, reference hereinafter will only be made to these two panels to illustrate the most preferred method in which the present invention can be exercised. It will be appreciated that whilst the panels 11 and 12 are both shown to be of a foam and fabric ply laminated assembly this need not always be so. For example it may well be that at certain regions, only fabric material is presented by each of the panels 11, 12 or that only one of the panels incorporates foam. Variations including any additional panels or plies may be included, including assemblies and constructions as described in US 20040224604.

Whilst in FIG. 2 the panels 11 and 12 are shown being defined by the plies 13, 15 and 14, 16 that are substantially contiguous plies, this also need not be necessarily so. It may well be that in certain regions the foam ply 13 or 14 of either of the panels 11, 12 is not present at where a fastener is to be located. The removal of the foam may have been as a result of skiving or as a result of the precursor panels 11 and/or 12 having been fabricated without foam in certain regions.

The over the shoulder straps 9, 10 may also be formed from the same contiguous plies of material of the panels 11, 12 or may alternatively be of a separately attached component that can become affixed for example at the breast cup regions 2, 3 through ultrasonic welding or adhesive affixing.

It will be appreciated by a person skilled in the art that the present invention need not necessarily be utilised in conjunction with bras that have over the shoulder straps. The present invention does have applicability to commonly known "strapless bras".

Figure 3:
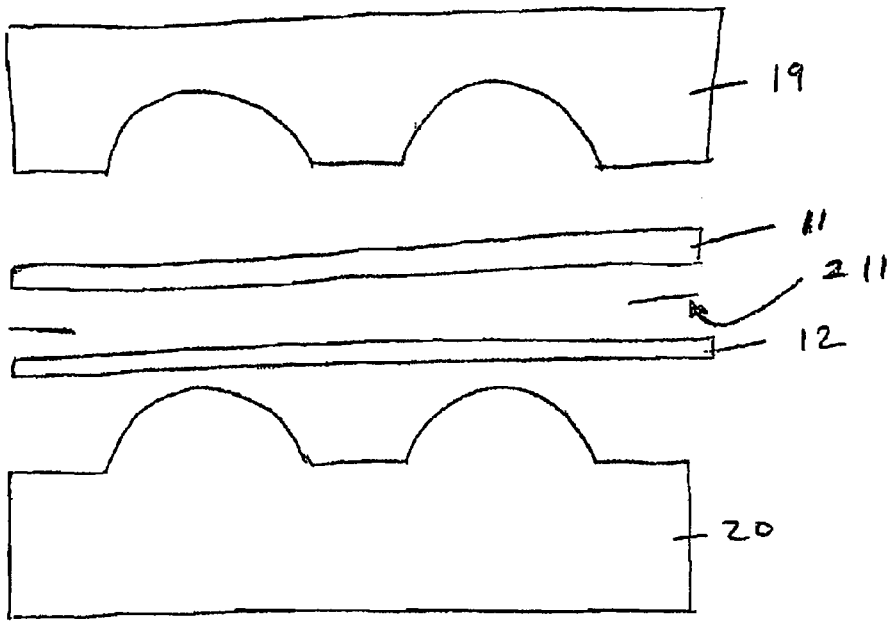
FIG. 3 is a sectional view through a molding device including, intermediate of the upper and lower molds, the positioning of the two precursor panels of FIG. 2 in addition to two release plies.

In the most preferred form of the invention the three dimensional cup shape and outline of the shape 17 of the main component of the bra is defined by a molding device that includes upper and lower mold portions 19, 20. With reference to FIG. 3, these upper and lower mold portions 19, 20 are shown separated. Intermediate and in an as yet unlaminated form, the contiguously positioned panels 11, 12 are located. Mold closure (the bringing together of the upper and lower mold portions 19, 20) and with the application of heat will result in the panels 11, 12 from being pressed together to become laminated together to form a laminated and shaped form. This laminated and shaped form can later be perimeter trimmed to define a shape such as the shape 17 shown in FIG. 2. In an alternative form of the present invention the three dimensional shape of the regions of the bra may at this stage not be incorporated, yet the panels 11 and 12 are substantially laminated together. Whilst in the most preferred form lamination and forming can occur simultaneously, in the alternative form lamination may occur first and forming of the shape 17 and its three dimensional characteristics may occur after lamination.

During forming and/or lamination a release ply 211 is utilised.

A release ply 211 is located intermediate of the panels 11, 12 at a region where a fastener is to become engaged. During the forming and/or lamination of the panels 11, 12, the release plies 211 is located at predetermined regions to ensure that no lamination of the exterior and interior more panels 11, 12 occurs at such regions. The release ply 211 may for example be an oil paper or a release paper that does not have a tendency or has a reduced tendency to become affixed to the mating plies of the panels 11 and 12 during their lamination together.

Figure 4:
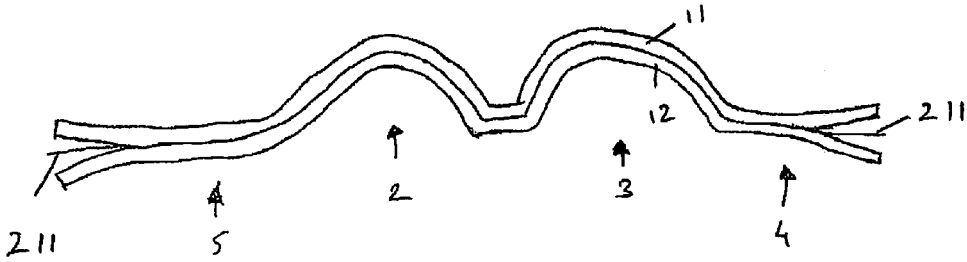
FIG. 4 is a sectional view through a molded and substantially laminated condition of the panels of FIG. 2.

With reference to FIG. 4 where a laminated and molded condition of the panels 11, 12 is shown, the release ply 211 is located at regions where the free ends of the chest bands 4, 5 are to be defined. They are shown ready for removal from intermediate of the panels 11, 12.

Figure 5:
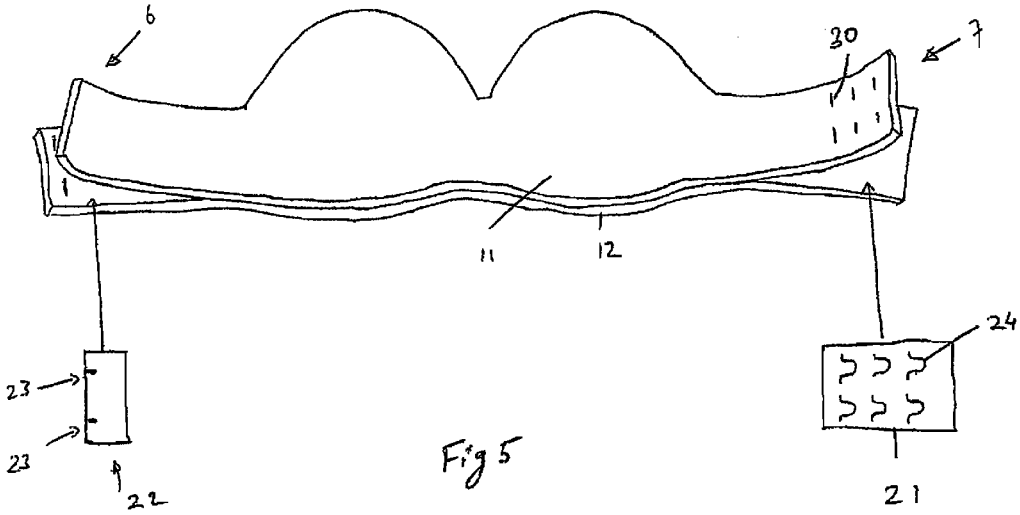
FIG. 5 is a perspective view of the molded and laminated panels prior to the insertion of the fasteners at the free ends of the chest band portions.

With reference to FIG. 5, there is shown the laminated and molded form of the panels 11, 12 with the release plies 211 removed. The free ends 6, 7 are in a condition such that the panels 11, 12 are not laminated together thereat.

At or near the free ends, fasteners 21, 22 can now become located intermediate of the panels 11, 12. With reference to FIG. 5, a first of the fasteners is an eye fastener 21, the other fastener is a hook fastener 22. The hook fastener 22 may define two hooks 23. The eye fastener may include a plurality of eyes 24. As can be seen there are two rows of eyes, each row having three eyes presented. The spacing of the rows is the same as the spacing between the two hooks 23.

Figure 6:
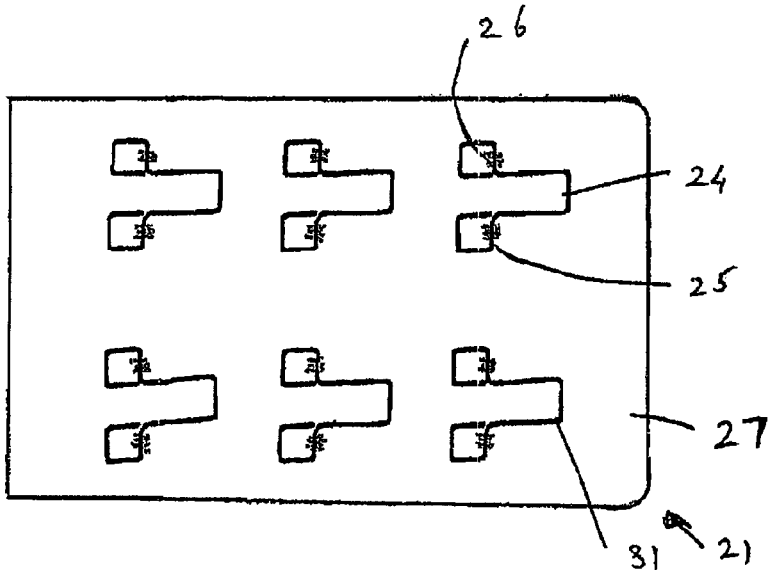
FIG. 6 is a plan view of an eye fastener.

With reference to FIG. 6 which shows the eye fastener 21, it can be seen that each eye 24 may be made from a metal wire which includes a loop region 31 which is the functional region for fastening of the eye 24 and a base region 25. At the base region 25, an eye 24 is stitched by stitching 26, to a flexible mounting panel or tape 27. The flexible mounting panel 27 is preferably of a fabric or other flexible material. The flexible mounting panel 27 supports each of the eyes 24 that may each be stitched to the flexible mounting panel 27 at desired locations.

Figure 7:
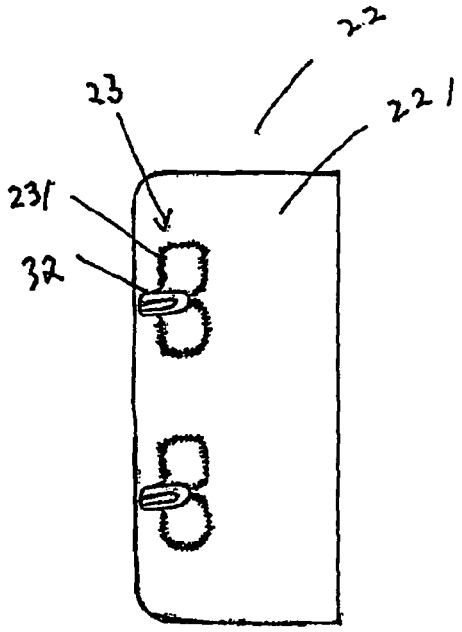
FIG. 7 is a plan view of a hook fastener.

In a similar way and with reference to FIG. 7, the hook fastener 22 may have the hooks 23 stitched by stitching to a flexible mounting panel or tape 221 at the base region 231.

In the most preferred form the flexible mounting panel 27, 221 is substantially planar although preferably of a flexible nature. It is preferably of a fabric or other flexible material, and is preferably relatively thin, comprising of a single piece of material. The hooks and eyes are affixed to a respective flexible mounting panel so as to project their functional regions (such as the loop region 31 or the hook region 32), away from a surface or edge of the flexible mounting panel to allow for the functional regions to be presented for convenient engagement by the other of the hooks and eyes for fastening the chest band to the wearer of a person. With reference to FIG. 6, the functional regions 31 of the eyes 24 project away from one of the major surfaces of the flexible mounting panel 27. This can be more clearly seen with reference to FIG. 8. Similarly for the functional regions 32 of the hooks 23.

The fasteners 21 and 22 are to be located intermediate of the panels 12, 11 at the regions where non-lamination of the panels has been effected by the use of the release ply 211.

Whilst a substantial part of the fastener 21 or 22 is to be captured intermediate of the panels 11, 12 the functional regions 31, 32 of the eyes 24 and of the hooks 23 are to be presented to the exterior of the bra so as to allow for these to become functionally operative for engagement. Accordingly for each of the fasteners, one of the exterior and interior more panels is provided with a slit corresponding in location to each of the hooks and eyes. With reference to FIG. 5, it can be seen on the right hand side that six slits 30 have been formed to allow for an opening to be created through the exterior more panel 11. Each slit 30 is of a size sufficient to allow for part of the eye 24 to extend through the slit. Whilst the majority of a fastener is captured intermediate of the interior and exterior more panels the functional region of for example an eye 24 is presented exterior of the interior or exterior more panel and this can be achieved by allowing part of the eye 24 to extend through such a slit. This is for example shown with reference to FIG. 9, wherein part of the eye 24 is shown to extend through the exterior more panel 11.

Figure 10:
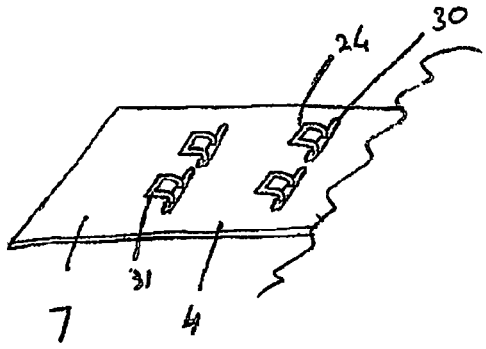
FIG. 10 is a perspective view of the free end of a chest band illustrating the eyes extending through slits provided in a panel of the chest band to present the eyes for fastening with the hooks.
Figure 11:
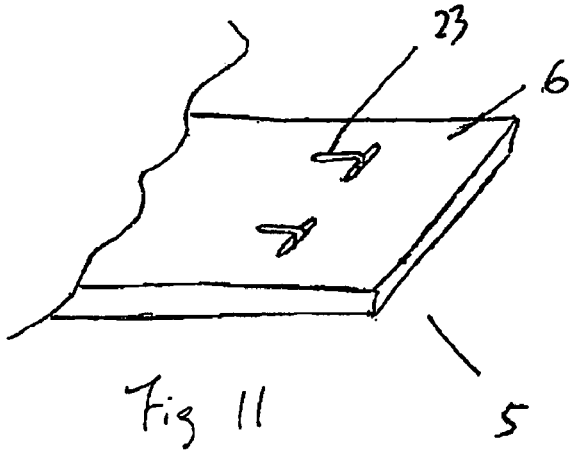
FIG. 11 is a perspective view of the free end of the other chest band illustrating the hooks extending through slits provided in a panel of the chest band to present the hooks for fastening with the eyes.

The slit 30 (which may also be a larger opening sufficient to allow the hook or eye to pass through) is preferably provided by a cutting of the interior and/or exterior more panels in an appropriate location. Where additional panels or plies are provided at the region where the fasteners are to be located, then cutting through such additional plies or panels will also need to occur to allow for the part of the hook or eye to pass through such an opening to be presented to the exterior for engagement with its counterpart. With reference to FIG. 10, it can be seen that part of each of the eyes 24 is presented to an exterior of the bra at a free end 7 of a chest band 4. The eyes extend through the slits 30 so as to be presentable therefrom. Similarly, with reference to FIG. 11, part of each of the hooks 23 is presented to an exterior of the bra at the free end 6 of the other chest band 5.

Whilst for the purposes of allowing for the fasteners to become located intermediate of the interior and exterior more panels at or near the free end of the chest bands, no lamination at such a region of the interior and exterior more panels occurs, once the fasteners are in location intermediate of the interior and exterior more panels at such a region and the functional regions of the fasteners are presented through the slits to the exterior of the bra, lamination at such a region can then occur of the interior and exterior more panels.

Accordingly further lamination at the region at where the fastener is affixed intermediate of the interior and exterior more panels 12, 11 occurs once the fastener has been located at such a region. Such lamination will capture a substantial portion of the fastener 21 or 22 intermediate of the interior and exterior more panels save for the functional regions 31, 32 of the hooks and/or the eyes that are presented through the slits as hereinbefore described.

Figure 8:
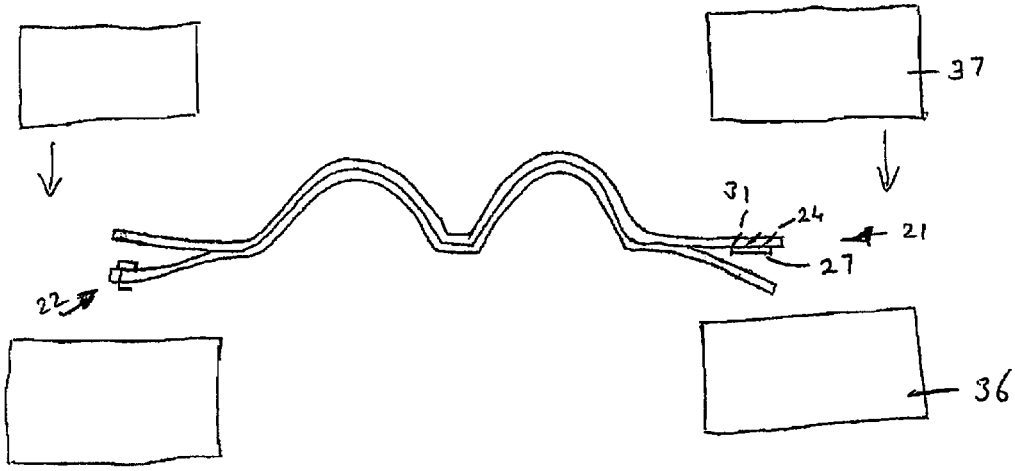
FIG. 8 illustrates a step in the process of incorporating the fasteners with the main brassiere component.

With reference to FIG. 8, lamination may occur by the application of heat and/or pressure, facilitating elements 36, 37 that are brought together to bear onto the said region, to effect such lamination.

Figure 9:
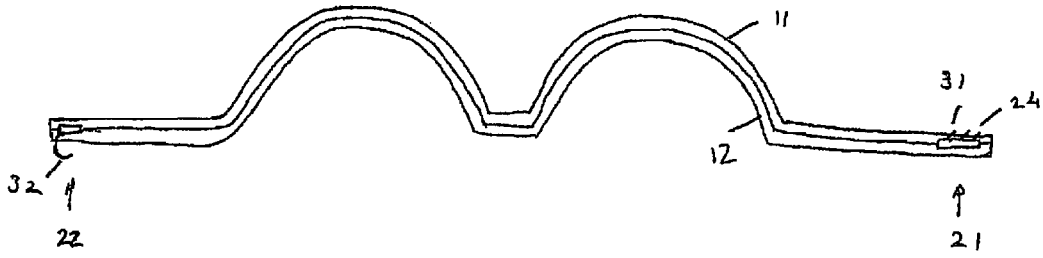
FIG. 9 is a sectional view through the main brassiere component wherein a fastener is engaged at the free end of each of the chest bands.

With reference to FIG. 9, a laminated condition of the exterior and interior more panels 11, 12 at the regions at where the fasteners are engaged, is shown. Such a laminated and shaped form can then be perimeter trimmed to form the main component of the bra.

Lamination at said regions is in part occurring of an exterior and interior more panels 11, 12 but also of the exterior and/or interior more panels 11, 12 to the flexible mounting panels 27, 221. Such lamination to the flexible mounting panels 27, 221 facilitates securing of the fasteners.

To facilitate thorough affixing and lamination of the exterior and interior more panels 11, 12 to, for example, the flexible mounting panel 27 of the loop fastener 21, a thermo sensitive adhesive may be applied intermediate of the mating surfaces. In the most preferred form such a thermo sensitive adhesive is a thermo sensitive adhesive film (such as Sewfree® 3410 produced by Bemis Associates, Inc.) which is pre-applied, for example by ironing, to one or both sides of the flexible mounting panel 27, 221 of the fastener. During lamination at the region where the fastener is to be affixed, the thermo sensitive adhesive is activated by heat and pressure to facilitate thorough adhesion between one or both of the panels 11, 12 and the flexible mounting panel 27.

As can be seen with reference to FIG. 9, the eye fastener 21 is presented to have its functional region 31 projecting through the exterior more ply 11 and the hook fastener 22 has its functional region 32 extending through the interior more panel 12. When the chest band regions are folded around part of the torso of the wearer of the person, the hook fastener 22 and the eye fastener 21 are presented to allow for mutual engagement to occur.

The fasteners are in a substantial part captured between the panels 11, 12 of the part of the bra of the present invention without the flexible mounting panels 27, 221 being visible on either side. In addition there are no seams or edges or hems formed for the purposes of capturing the flexible mounting panel 27, 221 intermediate of the panels 11, 12. This offers a very unassuming and unobtrusive appearance to a bra at the region where such a fastener is located. Because of the absence of a hem, irritation to the skin of a wearer is also reduced.

Whilst reference herein is made to the incorporation of fasteners for the purposes of allowing the chest band regions to become capable of fastening together, it will be appreciated that fasteners may also be used in other regions of the bra such as for example for the purposes of attaching the over the shoulder straps to the bra, or of joining the two breast cups together in an open front bra. Accordingly it is within the scope of the invention to provide the methods herein described and the bra so formed for the purposes of incorporating fasteners in such a manner, at other regions of the bra.

Further, whilst reference herein is made to the use of hooks and eyes for fastening purposes, it will be appreciated that any other form of connectors or clasps may be used for fastening purposes as long as they can be captured in part within panels of a bra.

Also, whilst reference herein has been made to the use of a release ply to separate regions at where a fastener is to be engaged between the exterior more and interior more panels, it will be appreciated by a person skilled in the art that alternatively non-lamination at such regions can be achieved by not applying any pressure and/or heat during the lamination stage of the interior and exterior more plies at such region. In addition, lamination between the interior and exterior more plies may be facilitated by the use of an adhesive such as a thermo reactive adhesive. Such an adhesive may not be applied to the mating surfaces of the interior and exterior more plies at the region where the fastener is to be located so as to avoid lamination of the interior and exterior more panels together at such a region. However in the most preferred form the release ply, preferably in the form of a release paper, can be used to accurately define the region of non-lamination.

It will be appreciated that reference herein has been made to exterior more and interior more panels to define the relative relationship between the panels. The panels so referred to may however not be the panels that are outward most in the bra assembly as other panels or plies may be outermost. Interior more refers to the panel being more proximate the side of the bra to the wearer than the exterior more. Furthermore the contiguous nature of the relationship of the panels indicates that whilst preferably the panels are in direct contact with each other over their entire facing surface, there may be plies of material or substance intermediate. For example adhesive may be located intermediate. The panels are however preferably in direct contact and substantially coextensive with each other.

While the present invention has been described with reference to particular embodiments thereof, it will be understood that such embodiments are susceptible of modifications and variations without departing from the scope of the present invention and that the invention will include all embodiments falling within the scope of the appended claims.

The invention claimed is:

1. A method of incorporating a fastener with a molded brassiere that is of a seamless construction and that includes an exterior brassiere panel of moldable material and an interior panel of moldable material that is contiguous with said exterior brassiere more panel and has been laminated therewith except at at least a non-laminated region where said fastener is to be located, and wherein said fastener includes a connector supported by a flexible mounting panel, said method comprising;

creating an opening through one of said exterior brassiere panel and said interior brassiere more panel at said non-laminated region and at a location thereof through which at least part of said connector is to extend, locating said flexible mounting panel intermediate of said exterior brassiere panel and said interior brassiere panel at said non-laminated region in a manner to allow said at least part of said connector to extend through said opening, affixing at least one of said exterior brassiere panel and said interior brassiere panel to said flexible mounting panel.

2. A method as claimed in claim 1 wherein said connector is selected from one of a hook and an eye.

3. A method as claimed in claim 1 wherein said affixing of at least one of said exterior brassiere panel and said interior brassiere panel to said flexible mounting panel is by laminating.

4. A method as claimed in claim 1 wherein said affixing is facilitated by a thermo sensitive adhesive intermediate of said flexible mounting panel and one or both of said interior and exterior brassiere panels, and said method comprises applying heat and pressure to push said exterior and interior brassiere panels towards each other to laminate at least one of said exterior and interior brassiere panels with said flexible mounting panel.

5. A method as claimed in claim 4 wherein said thermo sensitive adhesive is pre-applied to said flexible mounting panel.

6. A method as claimed in claim 1 further comprising engaging said fastener at or near a free end of a chest band region of said brassiere.

7. A method as claimed in claim 1 further comprising incorporating two of said fasteners with said molded brassiere, wherein a first of said fasteners includes a hook as said connector engaged at a free end of a first chest band region of said brassiere, and a second of said fasteners includes a loop as said connector engaged at a free end of a second chest band region of said brassiere and operable to cooperate with said hook to engage the free ends of each said chest band region together.

8. A method as claimed in claim 1 further comprising entirely capturing said flexible mounting panel between said exterior and interior brassiere panels and said at least part of said connector protrudes through said opening.

9. A method as claimed in claim 1 wherein said flexible mounting panel supports a plurality of said connectors and a separate opening is provided for each of said connections through said exterior or interior brassiere panels.

10. A method of capturing a fastener intermediate of an exterior brassiere panel of moldable material and an interior brassiere panel of moldable material that are to define the breast cup regions and chest band regions of a molded brassiere which is of seamless construction wherein said exterior brassiere panel is contiguously laminated with said interior brassiere panel except at at least a non-laminated region where said fastener is to be located, wherein said fastener includes a connector supported by a flexible mounting panel, said method comprising;

creating an opening through one of said exterior brassiere panel and said interior brassiere panel at said non-laminated region and at a location thereof through which at least part of said connector is to extend, locating said flexible mounting panel intermediate of said exterior brassiere panel and said interior brassiere panel at said non-laminated region in a manner to allow said at least part of said connector to extend through said opening, and affixing at least one of said exterior brassiere panel and said interior brassiere panel to said flexible mounting panel.

11. A method as claimed in claim 10 wherein said exterior and interior brassiere panels are molded to introduce two breast cup regions simultaneously with the affixing of at least one of said exterior brassiere panel and said interior brassiere panel to said flexible mounting brassiere panel.

12. A method as claimed in claim 10 wherein said connector is selected from one of a hook and an eye.

13. A method of making a brassiere comprising laminating an exterior moldable brassiere panel with a contiguous interior moldable panel except at at least one region, locating at said at least one region and intermediate of said exterior moldable brassiere panel and said interior moldable brassiere panel a flexible mounting panel supporting a connector in a manner to protrude at least part of said connector through an opening in of one of said interior and exterior moldable brassiere panels, and affixing at least one of said interior and exterior moldable brassiere panels to said flexible mounting panel.

14. A method as claimed in claim 13 wherein said connector is selected from one of a hook and an eye.

15. A method as claimed in claim 13 wherein said affixing is by laminating to capture said flexible mounting panel intermediate of said exterior and interior moldable brassiere panels.

16. A method as claimed in claim 13 further comprising during said laminating of said interior and exterior moldable panels, placing a release ply intermediate of said interior and exterior molded panels.

17. A molded and seamless brassiere comprising;

an interior brassiere panel of at least one ply of a moldable material, an exterior brassiere panel of at least one ply of a moldable material, wherein at least one of said plies of said exterior brassiere panel is contiguous with at least one of said plies of said interior brassiere panel, and wherein said panels are laminated to each other except at at least one region where a flexible mounting panel supporting a connector is laminated to at least one of said interior and exterior brassiere panels for capturing the flexible mounting panel intermediate of said interior and exterior brassiere panels, wherein said connector is affixed to and at least in part projects from said flexible mounting panel, and wherein one of said interior and exterior brassiere panels includes an opening therethrough for that part of said connector that projects from said flexible mounting panel to extend through.

18. A molded and seamless brassiere as claimed in claim 17 wherein said connector is selected from one of a hook and an eye.

19. A molded and seamless brassiere as claimed in claim 18 wherein said interior and exterior brassiere panels each extends to define two breast cup regions of said brassiere and two chest band portions, each one of said chest band portions extending from a respective breast cup region to a free end of said chest band portion, wherein at said free end of one of said chest band portions, said flexible mounting panel is located to present at least part of said connector through one of said interior and exterior brassiere panels for fastening with a complementary shaped connector engaged at the free end of the other of said chest band portions.

20. A molded and seamless brassiere as claimed in claim 19 wherein said complementary shaped connector is mounted by a flexible mounting panel and the other connector is selected from said hook and eye, the other of said chest band portions capturing a second mounting panel intermediate of said interior and exterior brassiere panels and including an opening through one of said interior brassiere panel and said exterior brassiere panel to allow at least part of said complementary shaped connector to pass therethrough.

21. A molded and seamless brassiere that includes an exterior brassiere panel that includes at least one ply of moldable material and an interior brassiere panel that includes at least one ply of moldable material, said interior brassiere and exterior brassiere panels are contiguous to each other and define at least two breast cup regions and a chest band portion extending from each said breast cup region, said interior brassiere and exterior brassiere panels are laminated together except at at least a region proximate a free end of said chest band portion where a chest band fastener is located, wherein said chest band fastener includes one of a hook and an eye that is affixed to a flexible mounting panel captured intermediate of and laminated to said interior and exterior brassiere panels, and one of said interior and exterior brassiere panels including an opening through which said hook or eye extends.

22. A method of incorporating a fastener with a molded brassiere of seamless construction and that includes an exterior brassiere panel of moldable material and an interior brassiere panel of moldable material that is contiguous with said exterior brassiere panel and is laminated therewith except at at least a non-laminated region where said fastener is to be located, and wherein said fastener includes a connector supported by a flexible mounting panel, said method comprising:

creating an opening through one of said exterior brassiere panel and said interior brassiere panel at said non-laminated region and at a location thereof through which at least part of said connector is to extend, locating said flexible mounting panel intermediate of said exterior brassiere panel and said interior brassiere panel at said non-laminated region in a manner to allow said at least part of said connector to extend through said opening, laminating at least one of said exterior brassiere panel and said interior brassiere panel to said flexible mounting panel, said laminating being facilitated by a thermo sensitive adhesive intermediate of said flexible mounting panel and one or both of said interior and exterior brassiere panels, and said method comprises applying heat and pressure to push said exterior brassiere and interior brassiere panels towards each other to laminate at least one of said exterior and interior brassiere panels with said flexible mounting panel.

23. A method as claimed in claim 22 wherein said connector is selected from one of a hook and an eye.

* * * * *